US006216670B1

(12) United States Patent
Anderson et al.

(10) Patent No.: US 6,216,670 B1
(45) **Date of Patent: *Apr. 17, 2001**

(54) HYDRAULICALLY-ACTUATED SYSTEM HAVING A VARIABLE DELIVERY FIXED DISPLACEMENT PUMP

(75) Inventors: Michael D. Anderson, East Peoria; Dennis H. Gibson, Chillicothe; Michael E. Pickell, Metamora; Jerry A. Wear, East Peoria, all of IL (US); Matthew D. Friede, Fort Wayne, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/414,798

(22) Filed: Oct. 8, 1999

Related U.S. Application Data

(63) Continuation-in-part of application No. 09/038,121, filed on Mar. 11, 1998, now Pat. No. 6,035,828.

(51) Int. Cl.[7] ..... F02M 37/04

(52) U.S. Cl. ..... 123/446; 123/506; 417/269

(58) Field of Search ..... 123/446, 447, 123/506, 299–300; 417/269, 283, 284, 440

(56) References Cited

U.S. PATENT DOCUMENTS

| | | | |
|---|---|---|---|
| 2,393,544 | 1/1946 | Lum . | |
| 4,531,492 | 7/1985 | Gibson . | |
| 4,531,494 | 7/1985 | Bailey et al. . | |
| 4,541,391 | 9/1985 | Gibson . | |
| 5,357,912 | 10/1994 | Barnes et al. . | |
| 5,404,855 | 4/1995 | Yen et al. . | |
| 5,485,820 | 1/1996 | Iwaszkiewicz . | |
| 5,515,829 | 5/1996 | Wear et al. . | |
| 5,540,203 | 7/1996 | Foulkes et al. . | |
| 5,564,386 | 10/1996 | Korte et al. . | |
| 5,564,391 | 10/1996 | Barnes et al. . | |
| 5,603,609 | 2/1997 | Kadlicko . | |
| 6,035,828 * | 3/2000 | Anderson et al. | 123/506 |

FOREIGN PATENT DOCUMENTS

| | | |
|---|---|---|
| 5637/70 | 4/1970 | (CH) . |
| 0 307 947 | 9/1988 | (EP) . |
| 0 459 429 A1 | 5/1991 | (EP) . |
| 97/47883 | 12/1997 | (WO) . |

* cited by examiner

*Primary Examiner*—Thomas N. Moulis
(74) *Attorney, Agent, or Firm*—Michael B. McNeil

(57) ABSTRACT

A hydraulically-actuated system includes a fixed displacement pump with at least one piston that reciprocates in a pump housing that defines a high pressure area and a low pressure area. A control valve is attached to the pump housing and moveable between a first position in which the piston displaces fluid in a first proportion between the high pressure area and the low pressure area, and a second position in which the piston displaces fluid in a second proportion between the high pressure area and the low pressure area. At least one hydraulically-actuated device is connected to the high pressure area of the pump. A source of low pressure fluid is connected to the low pressure area of the pump. An electronic control module is in communication with and capable of controlling the position of the control valve.

20 Claims, 7 Drawing Sheets

SOLENOID CURRENT

POPPET POSITION

SHAFT POSITION

HYDRAULICALLY-ACTUATED SYSTEM HAVING A VARIABLE DELIVERY FIXED DISPLACEMENT PUMP

RELATION TO OTHER PATENT APPLICATION

This application is a continuation-in-part of application Ser. No. 09/038,121, filed Mar. 11, 1998 and entitled Hydraulically-Actuated System Having a Variable Delivery Fixed Displacement Pump, now U.S. Pat. No. 6,035,828.

TECHNICAL FIELD

The present invention relates generally to pumps and hydraulically-actuated systems used with internal combustion engines, and more particularly to a variable delivery fixed displacement pump and its associated system.

BACKGROUND ART

U.S. Pat. No. 5,515,829 to Wear et al. describes a variable displacement actuating fluid pump for a hydraulically-actuated fuel injection system. In this system, a high pressure common rail supplies pressurized lubricating oil to a plurality of hydraulically-actuated fuel injectors mounted in a diesel engine. The common rail is pressurized by a variable displacement swash plate type pump that is driven directly by the engine. Pressure in the common rail is controlled in a two-fold manner. First, some pressure control is provided by electronically varying the swash plate angle within the pump. However, because variable angle swash plate type pumps typically have a relatively narrow band of displacement control, pressure in the common rail is primarily controlled through an electronically controlled pressure regulator. The pressure regulator returns a portion of the pressurized fluid in the common rail back to the low pressure fluid sump in order to maintain fluid pressure in the common rail at a desired magnitude.

While the Wear et al. hydraulically-actuated system using a variable displacement pump has performed magnificently for many years in a variety of diesel engines manufactured by Caterpillar, Inc. of Peoria, Ill., there remains room for improvement. On the overall level, the Wear et al. system is relatively more complex in that the control scheme in its electronic control module must simultaneously control both the angle of the swash plate within the high pressure pump and the amount of fluid spilled via the pressure regulator. Also, variable angle swash plate type pumps are relatively complex, and thus more prone to mechanical breakdown relative to simple fixed displacement type pumps. Finally, the Wear et al. system inherently wastes energy that inevitably results in a higher than necessary fuel consumption for the engine. In other words, energy is wasted each time the pressure regulator spills an amount of pressurized fluid back to the low pressure sump.

In another class of fuel injection systems, an individual unit pump supplies pressurized fuel to each individual fuel injector. In still another class of fuel injection systems, an individual unit pump supplies actuating fluid to each individual hydraulically-actuated fuel injector. In both of these classes of fuel injection systems, the individual unit pumps are of a fixed displacement and fixed output type such that a substantial amount of energy is wasted in those instances where an amount of fuel injected corresponds to less than the full stroke of the individual unit pumps. In most instances, these fuel injection systems utilize electronically controlled spill valves on the fuel injectors themselves in order to control injection timing and/or quantity. However, because of space constraints at and around the engine head, compromises must often be made in order to accommodate such a spill valve in or on the fuel injector body, as well as the associated plumbing, etc.

The present invention is directed to overcoming these and other problems associated with, and improving upon, fluid pumps and their associated hydraulically-actuated systems.

DISCLOSURE OF THE INVENTION

A hydraulically-actuated system includes a fixed displacement pump with at least one piston that reciprocates in a pump housing that defines a high pressure area and a low pressure area. A control valve is attached to the pump housing and is moveable between a first position in which the piston displaces fluid in a first proportion between the high pressure area and low pressure area, and a second position in which piston displaces fluid in a second proportion between the high pressure area and the low pressure area. At least one hydraulically-actuated device is fluidly connected to the high pressure area, and a source of low pressure fluid is connected to the low pressure area of the pump. An electronic control module is in communication with and capable of controlling a position of the control valve.

BEST MODE FOR CARRYING OUT THE INVENTION

Figure 1:
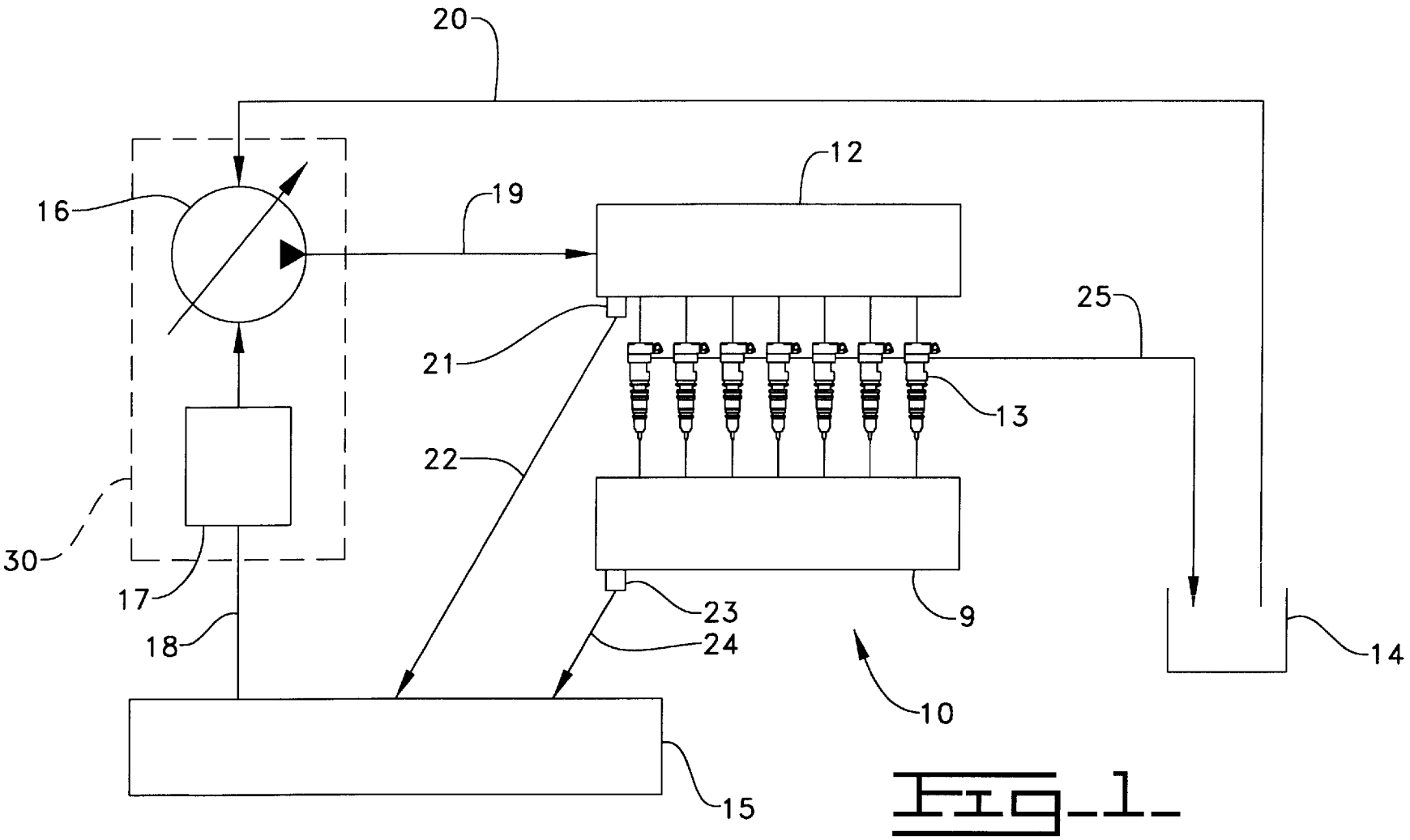
FIG. 1 is a schematic illustration of a hydraulically-actuated system according to the present invention.

Referring now to FIG. 1, a hydraulically actuated system 10 is attached to an internal combustion engine 9. The hydraulic system includes a high pressure common fluid rail 12 that supplies high pressure actuation fluid to a plurality of hydraulically-actuated devices, such as hydraulically-actuated fuel injectors 13. Those skilled in the art will appreciate that other hydraulically-actuated devices, such as actuators for gas exchange valves for exhaust brakes, could be substituted for the fuel injectors 13 illustrated in the example embodiment. Common rail 12 is pressurized by a variable delivery fixed displacement pump 16 via a high pressure supply conduit 19. Pump 16 draws actuation fluid along a low pressure supply conduit 20 from a source of low pressure fluid 14, which is preferably the engine's lubricating oil sump. Although other available liquids could be used, the present invention preferably utilizes engine lubricating oil as its hydraulic medium. After the high pressure fluid does work in the individual fuel injectors 13, the actuating fluid is returned to sump 14 via a drain passage 25.

As is well known in the art, the desired pressure in common rail 12 is generally a function of the engine's operating condition. For instance, at high speeds and loads, the rail pressure is generally desired to be significantly higher than the desired rail pressure when the engine is operating at an idle condition. An operating condition sensor 23 is attached to engine 9 and periodically provides an electronic control module 15 with sensor data, which includes engine speed and load conditions, via a communication line 24. In addition, a pressure sensor 21 periodically provides electronic control module 15 with the measured fluid pressure in common rail 12 via a communication line 22. The electronic control module 15 compares a desired rail pressure, which is a function of the engine operating condition, with the actual rail pressure provided by pressure sensor 21.

If the desired and measured rail pressures are different, the electronic control module 15 commands movement of a control valve 17 via a communication line 18. The position of control valve 17 determines the amount of fluid that leaves pump 16 via high pressure supply conduit 19 to high pressure rail 12. Both control valve 17 and pump 16 are preferably contained in a single pump housing 30. Unlike prior art hydraulic systems, the present invention controls pressure in common rail 12 by controlling the delivery output from pump 16, rather than by wasting energy through the drainage of pressurized fluid from common rail 12 in order to achieve a desired pressure.

Figure 2:
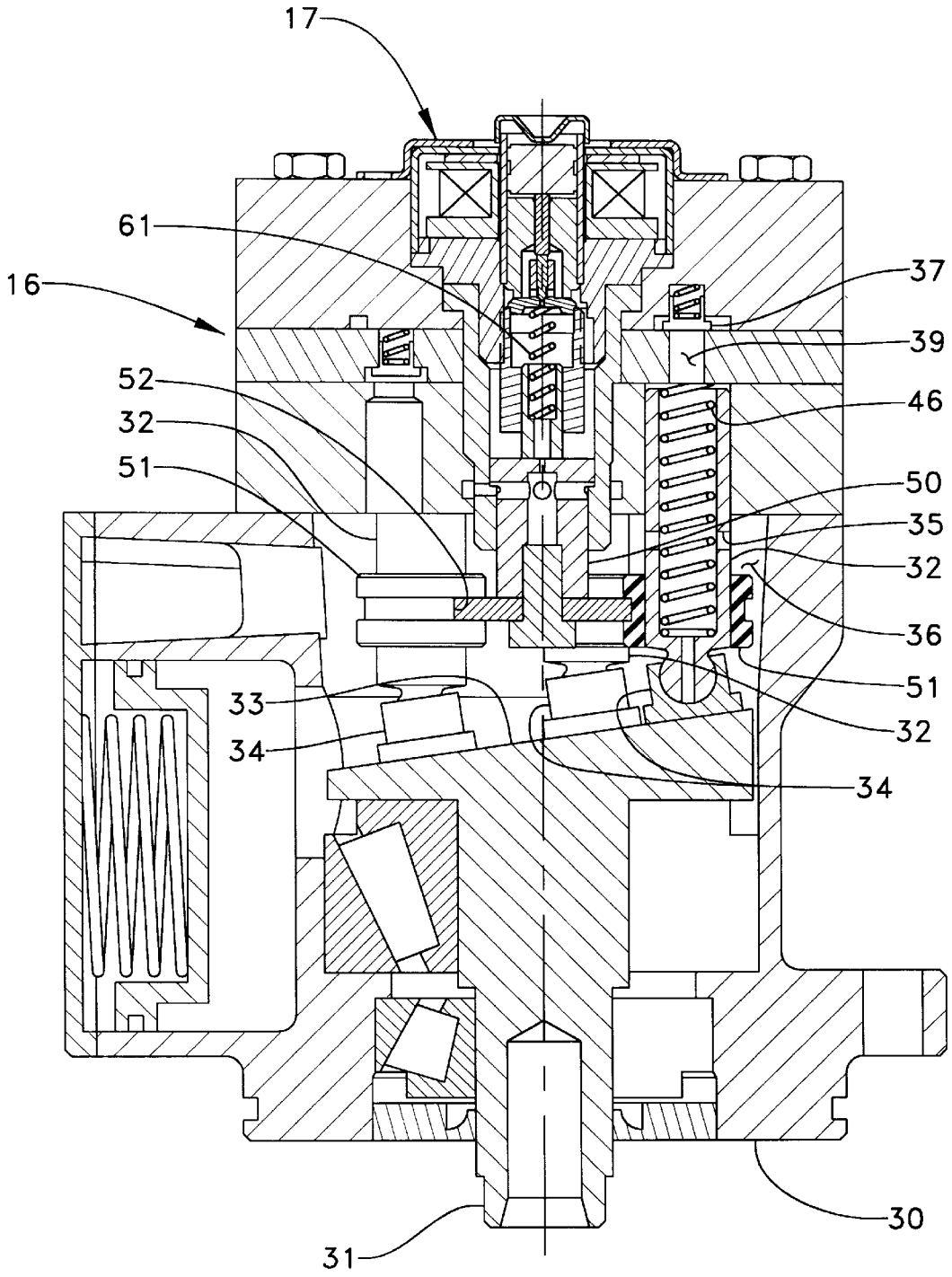
FIG. 2 is a sectioned side diagrammatic view of a fixed displacement pump according to one aspect of the present invention.
Figure 3:
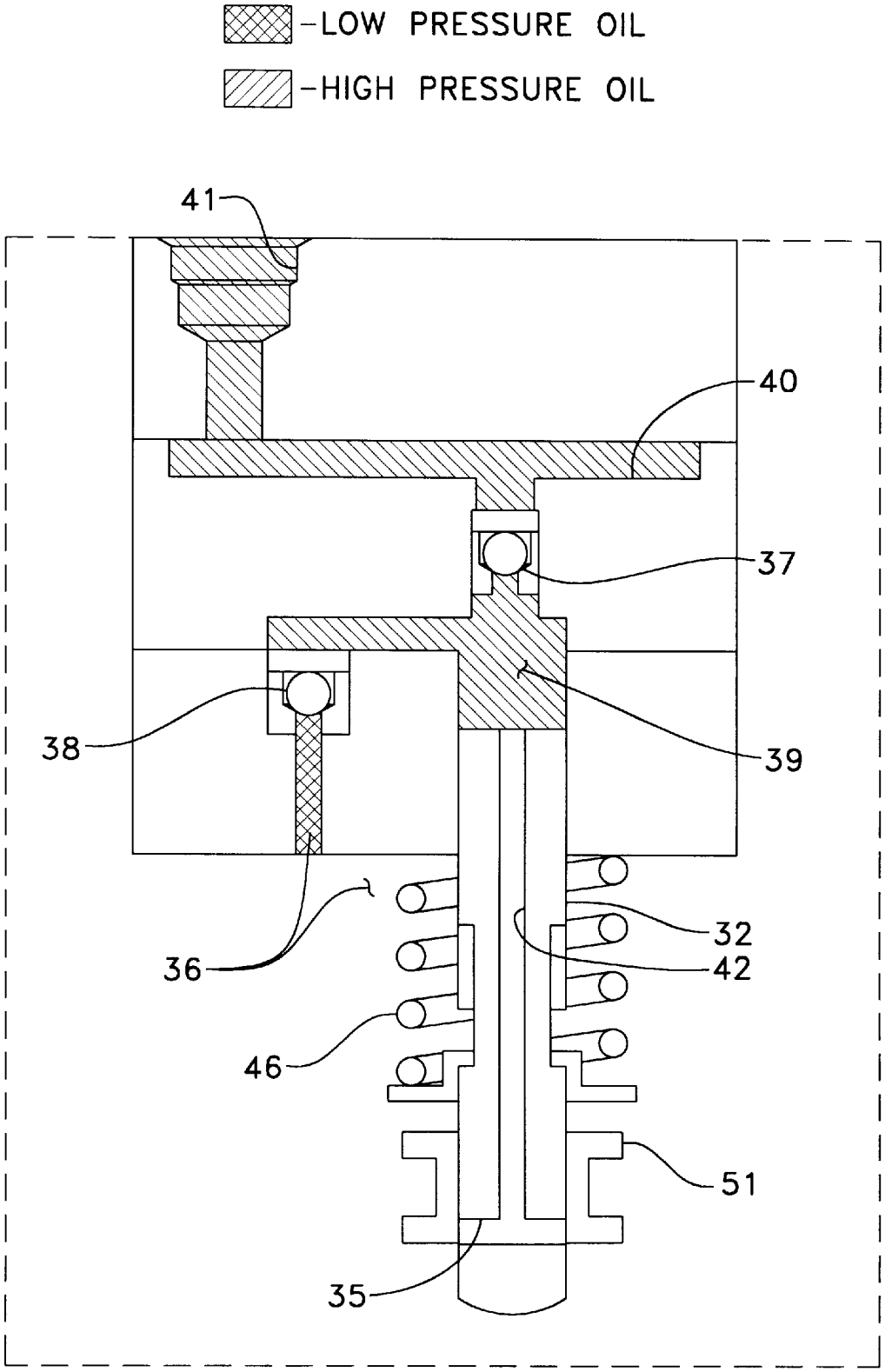
FIG. 3 is a schematic illustration of the fluid plumbing for one piston of the fixed displacement pump of FIG. 2.

Referring now to FIGS. 2–4, the various features of pump 16 are contained within a pump housing 30. Pump 16 includes a rotating shaft 31 that is coupled directly to the output of the engine, such that the rotation rate of shaft 31 is directly proportional to the drive shaft of the engine. A fixed angle swash plate 33 is attached to shaft 31. The rotation of swash plate 33 causes a plurality of parallel disposed pistons 32 to reciprocate from left to right. In this example, pump 16 includes five pistons 32 that are continuously urged toward swash plate 33 by individual return springs 46. Return springs 46 maintain shoes 34, which are attached to one end of each piston 32 in contact with swash plate 33 in a conventional manner. Because swash plate 33 has a fixed angle, pistons 32 reciprocate through a fixed reciprocation distance with each rotation of shaft 31. Thus, pump 16 can be thought of as a fixed displacement pump; however, control valve 17 determines whether the fluid displaced is pushed into a high pressure area past check valve 37 or spilled back into a low pressure area 36 via a spill port 35.

The proportion of fluid displaced by pistons 32 to the respective high pressure area 40 (see FIG. 3) and low pressure area 36 within pump housing 30 is determined by the position of individual sleeves 51 that are mounted to move on the outer surface of the individual pistons 32. Each sleeve 51 is connected to move with a central actuator shaft 50 via an annulus 52. An actuator biasing spring 61 normally biases actuator shaft 50 toward the left to a position in which virtually all the fluid displaced by the individual pistons 32 escapes back into low pressure area 36 via spill port 35.

Pressure within pumping chamber 39, under each piston 32, can only build when internal passage 42 and spill port 35 are covered by a sleeve 51. When sleeve 51 covers spill port 35, fluid displaced by piston 30 is pushed past check valve 37, into a high pressure connecting annulus 40 and eventually out of outlet 41 to the high pressure rail 12. When pistons 32 are undergoing the retracting portion of their stroke due to the action of return spring 46, low pressure fluid is drawn into pumping chamber 39 from a low pressure area 36 within pump housing 30 past inlet check valve 38.

Figure 4A:
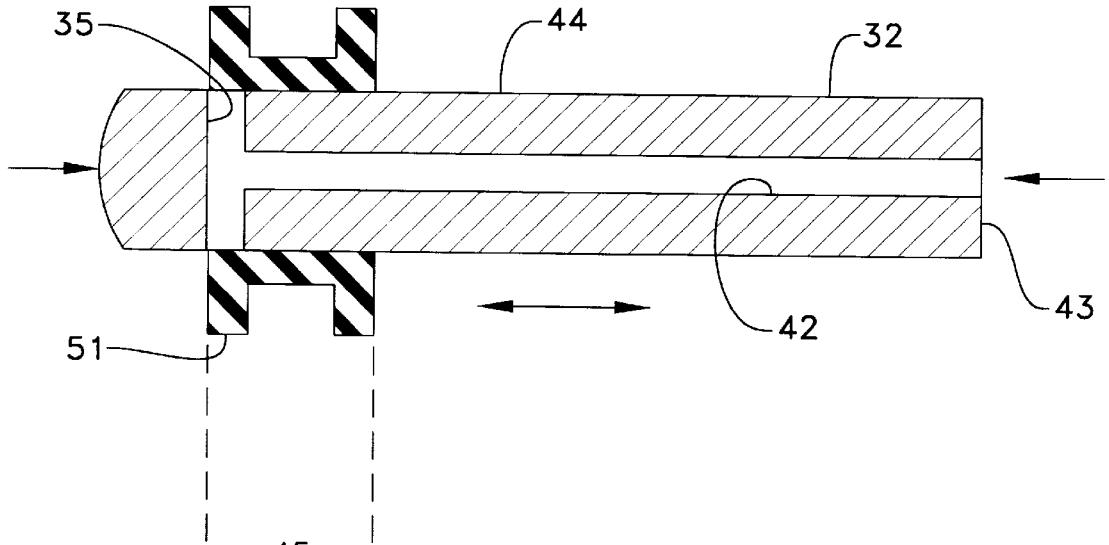
FIGS. 4*a* and 4*b* are schematic illustrations of the sleeve metering control feature for the fixed displacement pump of FIG. 2.
Figure 4B:
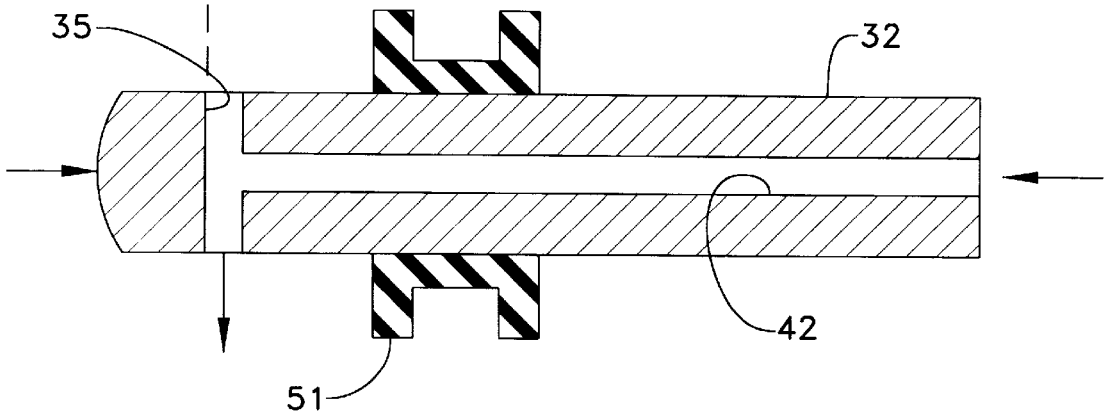

Referring now specifically to FIGS. 4*a* and 4*b*, the internal passage 42 within each piston 32 extends between its pressure face end 43 and its side surface 44. In this embodiment, the height of the individual sleeves 51 is about equal to the fixed reciprocation distance 45 of pistons 32. In this way, when sleeve 51 is in the position shown in FIG. 4*a*, all of the fluid displaced by piston 32 is pushed into the high pressure area 40 (FIG. 3) within the pump 16. On the other hand, when sleeve 51 is in the position shown in FIG. 4*b*, virtually all of the fluid displaced by piston 32 is spilled back into low pressure area 36 (FIGS. 2 and 3) within pump 16 via internal passage 42 and spill port 35. Thus, pump 16 can be characterized as variable delivery since the high pressure output is variable, but also be characterized as a fixed displacement swash plate type pump since the pistons always reciprocate a fixed distance.

Figure 5:
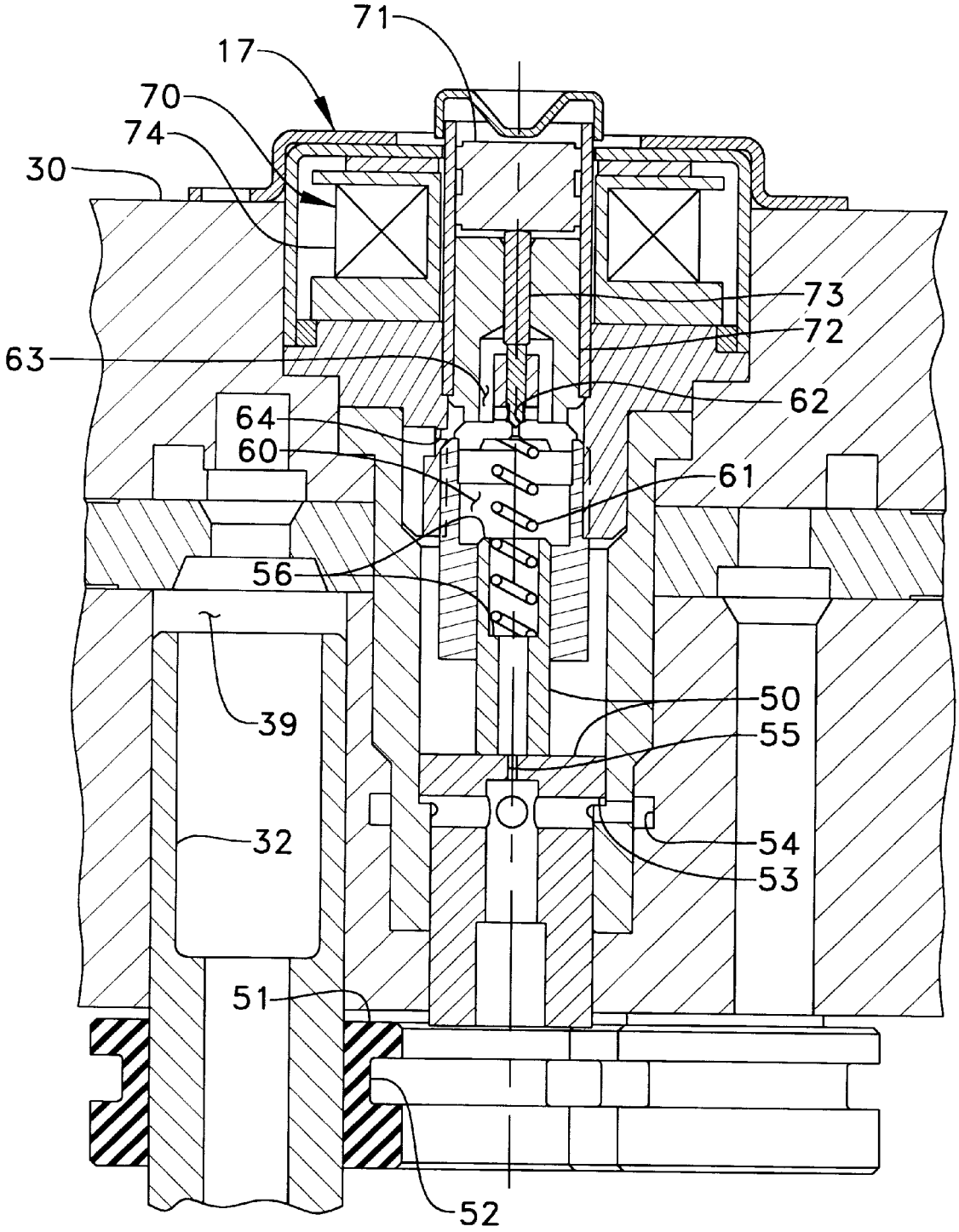
FIG. 5 is an enlarged side sectioned diagrammatic view of a control valve for controlling the delivery output of the fixed displacement pump of FIG. 2.

Referring now to FIG. 5, the internal structure of control valve 17, which controls the position of sleeves 51, is illustrated. Control valve 17 includes a linear actuator 70 that includes a solenoid armature 71, a stator 72, and a solenoid coil 74. A poppet valve member 73 is moved downward toward valve seat 62 when current is supplied to solenoid coil 74. Thus, when current is high, poppet valve member 73 is seated in valve seat 62 to close fluid communication between control volume 60 and a low pressure area 63, which is in fluid communication with a low pressure passage 64. When current is lower, fluid pressure in control volume 60 pushes poppet valve member 73 and armature 71 upward to open some fluid communication between control volume 60 and low pressure area 63 past valve seat 62.

As stated earlier, actuator shaft 50 is normally biased downward by a biasing spring 61. In addition to this spring force, actuator shaft 50 has a pair of opposing hydraulic surfaces that provide the means by which actuator shaft 50, and hence sleeves 51 are moved and stopped between the respective positions shown in FIGS. 4*a* and 4*b*. In particular, actuator shaft 50 includes a shoulder area 53 that is always in fluid communication with the high pressure area within pump 16 via a high pressure conduit 54. This high fluid pressure in conduit 54 is channeled via a central restricted communication passage 55 into control volume 60. Fluid pressure in control volume 60 acts on a control pressure surface 56, which is preferably about equal to the hydraulic surface area defined by shoulder area 53. Thus, when fluid pressure in control volume 60 is equal to the high pressure in conduit 54, the only force acting on actuator shaft 50 comes from biasing spring 61. This occurs when current to solenoid coil 70 is high such that poppet valve member 73 is pushed to close fluid flow past valve seat 62. When current to solenoid coil 74 is turned off, poppet valve member 73 is pushed off of valve seat 62 and the resulting fluid flow into low pressure area 63 lowers pressure in control volume 60 sufficiently that actuator shaft 50 has a tendency to move completely upward under the action of the high fluid pressure force acting on shoulder area 53. The pressure in control volume 60, and hence the position of actuator shaft 50 can be controlled to stop at any position depending upon the magnitude of the current being supplied to solenoid current 74. Thus, depending upon the current to solenoid coil 74, the amount of fluid pumped into the high pressure rail can be varied from zero to the maximum output of the pump. In the event of an electrical malfunction, over-pressurization of the rail is prevented since the actuator shaft 50 is biased downward by spring 61 where no high pressure output is produced.

Figure 7:
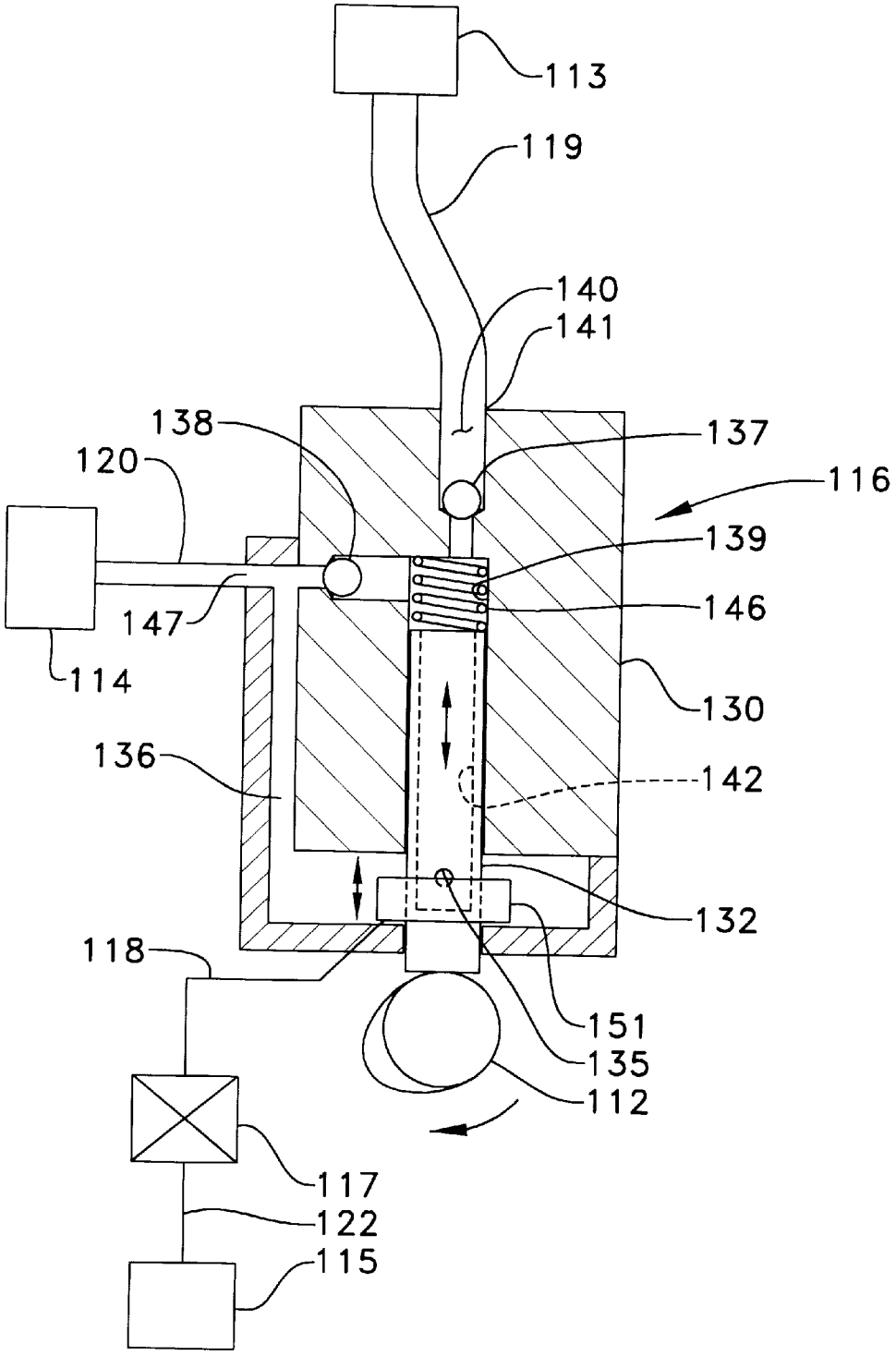
FIG. 7 is a schematic illustration of fixed displacement variable output unit pump according to the present invention.

Referring now to FIG. 7, a unit pump 116 version of the present invention is illustrated. In this embodiment, a cam 112 rotates to drive the reciprocation of a piston 132 that is at least partially positioned within a pump housing 130. The pump housing 130 defines a low pressure area 136 that includes an inlet 147 connected to a source of low pressure fluid 114 via a low pressure supply line 120. The pump housing 130 also defines a high pressure area 140 that includes an outlet 141 fluidly connected to a hydraulically-actuated device 113 via a high pressure supply line 119. The piston 132 and the pump housing 130 define a pump chamber 139 that is fluidly connected to the low pressure area 136 and the high pressure area 140 past respective check valves 138 and 139 in a conventional manner. Piston 132 is biased toward a retracted position to follow the contour of cam 112 by a return spring 146. As with the previous embodiment, piston 130 reciprocates through a fixed distance and thus displaces a fixed amount of fluid with each reciprocation. However, the relative proportions of the fluid displaced to high pressure area 140 and low pressure area 136 is controlled by the positioning of a sleeve 151. When sleeve 151 is in the position shown, virtually all of the fluid displaced by the movement of piston 132 is displaced into low pressure area 136 due to the fluid connection between pumping chamber 139 via internal passage 142 and spill port 135. The positioning of sleeve 151 is controlled via a suitable mechanical and/or hydraulic linkage to a control valve 117, which can be of a type described earlier. In other words, control valve 117 is controlled in its position via an electronic control module 115 via a communication line 122 in a conventional manner.

INDUSTRIAL APPLICABILITY

Figure 6A:
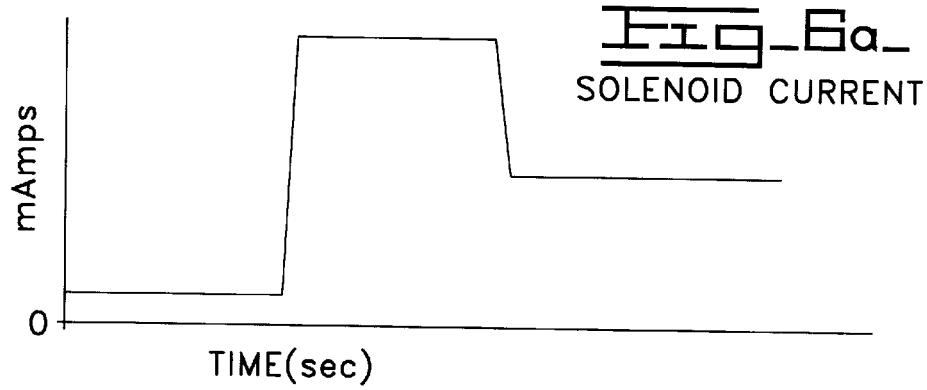
FIGS. 6*a–d* are graphs of solenoid current fluid pressure, poppet valve position and sleeve position, respectively, versus time for the hydraulically-actuated system of the present invention.
Figure 6B:
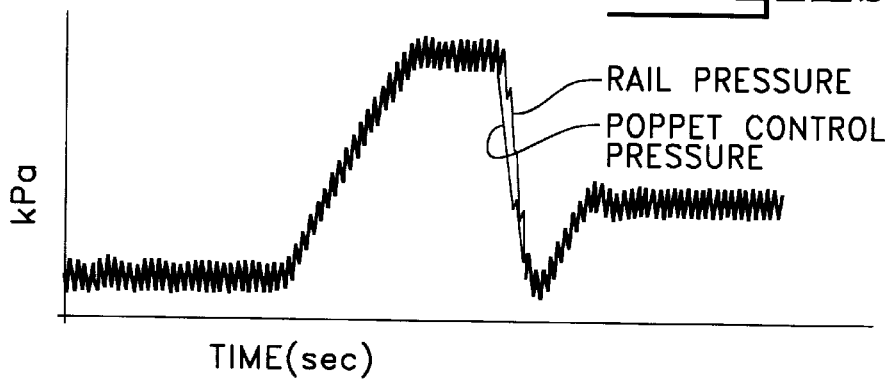
Figure 6C:
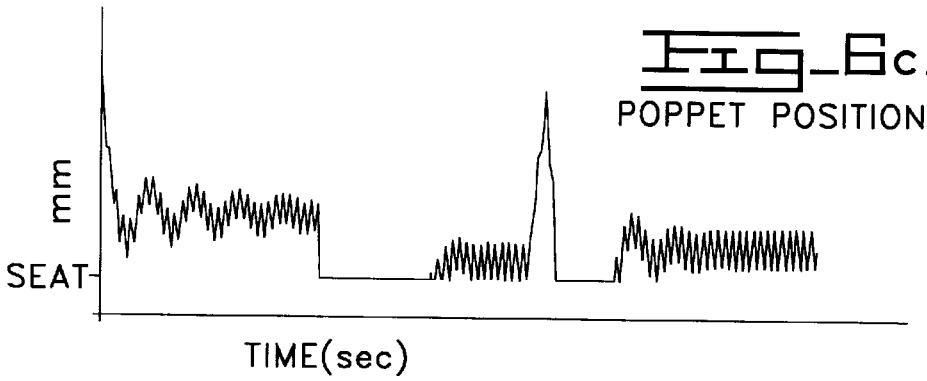
Figure 6D:
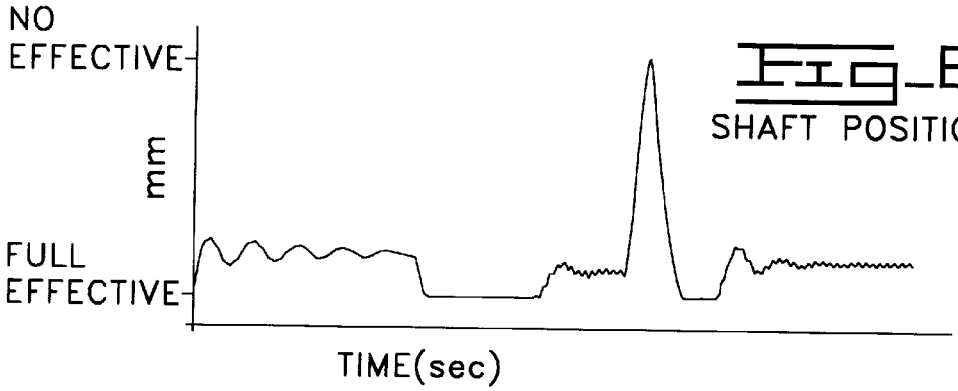

Referring now in addition to FIGS. 6*a–d,* the operation of hydraulically-actuated system 10 will be described and illustrated. FIGS. 6*a* and 6*b* illustrate that the steady state rail pressure is directly proportional to the steady state current being supplied to the solenoid portion of control valve 17. When solenoid current is low, rail pressure remains low. When solenoid current is high, rail pressure is raised accordingly. A medium current puts the rail pressure at a medium magnitude. The variation in solenoid current changes the amount of fluid being spilled past valve seat 62 which changes the fluid pressure in control volume 60. With each change in fluid pressure within control volume 60, actuator shaft 50 will seek out a new equilibrium position in which the hydraulic force acting on shoulder area 53 is balanced against the combined force from spring 61 and the hydraulic force acting on control pressure surface 56.

Of interest in FIGS. 6*a–*6*d* is when the system is commanded to raise rail pressure. When this occurs, solenoid current jumps and the poppet valve member is driven to close valve seat 62. This in turn causes actuator shaft 50 to move all the way to the left such that the complete stroke of the piston is utilized to pressurize fluid. This causes a rapid rise in rail pressure. When it is desired to lower the rail pressure, current to the solenoid is decreased. This quickly causes actuator shaft 50 to move to the right where the pistons have no effective pumping force. Pressure in the rail quickly drops as the hydraulically-actuated devices 13 continue to operate and consume the pressurized fluid in the common rail 12.

The present invention decreases the complexity of prior art hydraulically-actuated systems by having only one electronically-controlled device for controlling pressure in the high pressure rail. Recalling in the prior art, two different control schemes were necessary as one controlled the swash plate angle in the pump and the other controlled the pressure regulator attached to the high pressure rail. The present invention accomplishes the same task by only controlling high pressure output from the pump. The present invention also improves the robustness of the hydraulically-actuated system since fixed angle swash plate type pumps are generally more reliable and less complex than the variable angle swash plate type pumps of the prior art. In addition, only one electronically-controlled actuator is utilized in the present invention. Finally, the overall fuel consumption of the engine utilizing the present invention should be improved over that of the prior art since the pump only pressurizes an amount of fluid that is actually used by the hydraulic devices, and therefore almost no energy is wasted. Recalling that in the case of the prior art, pressure in the common rail was maintained at least in part by returning an amount of pressurized fluid back to the sump, which resulted in an efficiency drop and waste of energy.

Referring again to FIG. 7, when in operation in a hydraulic system, the unit pump 116 has the ability to deliver a precise amount of pressurized fluid to the particular hydraulically-actuated device 113. For instance, if hydraulically-actuated device 113 were a fuel injector, the amount of fuel injected can be about equal to the amount of fuel pressurized by unit pump 116, thereby avoiding wasted energy that occurs by pressurizing fluid only to spill a substantial amount of that pressurized fluid back for repressurization because it is not needed for a particular injection event. Those skilled in the art will appreciate that although the preferred version of the present invention includes sleeves that open and close a spill port on a pumping piston, some other suitable structure could be substituted that accomplishes the same task, such as some other component that opens and closes the spill port incorporated into the piston for a portion of its reciprocation distance.

The above description is intended for illustrative purposes only, and is not intended to limit the scope of the present invention in any way. For instance, other types of control valves could be substituted for the example illustrated control valve without departing from the intended scope of the present invention. Thus, those skilled in the art will appreciate that various modifications can be made to the illustrated embodiment without departing from the spirit and scope of the present invention, which is defined in terms of the claims set forth below.

What is claimed is:

1. A hydraulically actuated system comprising:

a fixed displacement pump with at least one piston defining an internal passage and that reciprocates in a pump housing which defines a high pressure area and a low pressure area;

a control valve attached to said pump housing and being moveable between a first position in which said piston displaces fluid in a first proportion between said high pressure area and said low pressure area, and a second position in which said piston displaces fluid in a second proportion between said high pressure area and said low pressure area;

a hydraulically actuated device fully connected to said high pressure area of said fixed displacement pump;

a source of low pressure fluid connected to said low pressure area of said pump;

an electronic control module in communication with and capable of controlling a position of said control valve; and a spring operably positioned to bias said control valve toward a position of which said piston displaces a majority of said fluid into said low pressure area.

2. The hydraulically actuated system of claim 1 wherein substantially all fluid displaced by said piston goes into said high pressure area when said control valve is at said first position; and substantially all fluid displaced by said piston goes into said low pressure area when said control valve is at said second position.

3. The hydraulically actuated system of claim 1 wherein said hydraulically actuated device is a fuel injector.

4. The hydraulically actuated system of claim 1 wherein said control valve includes a sleeve surrounding each said piston; and said sleeve being moveable with respect to said pump housing by an actuator between said first position and a second position.

5. The hydraulically actuated system of claim 4 wherein said internal passage extends between a pressure face end and a side surface; and each said sleeve blocks said internal passage of said piston over a portion of a reciprocation distance.

6. The hydraulically actuated system of claim 1 wherein each of said plurality of pistons moves a reciprocation distance with each pump cycle; and an actuator distance between said first position and said second position is about equal to said reciprocation distance.

7. The hydraulically actuated system of claim 1 further comprising a pressure sensor operably connected to said high pressure area and being capable of communicating a pressure signal to said electronic control module; and said position of said control valve is a function of said pressure signal.

8. The hydraulically actuated system of claim 7 further comprising an engine operating condition sensor capable of communicating an operating condition signal to said electronic control module; and said position of said control valve is also a function of said operating condition signal.

9. The hydraulically actuated system of claim 1 wherein said control valve includes an electronically controlled actuator attached to said pump housing, and being stoppable at a plurality of positions between said first position and said second position.

10. The hydraulically actuated system of claim 9 wherein electronically controlled actuator includes a solenoid; and said position of said actuator is proportional to an amount of current supplied to said solenoid.

11. A hydraulically actuated system comprising:

a fixed displacement pump with at least one piston defining an internal passage and that reciprocates in a pump housing that defines a high pressure area and a low pressure area;

a control valve attached to said housing and being moveable between a first position in which said piston displaces fluid in a first proportion between said high pressure area and said low pressure area, and a second position in which said piston displaces fluid in a second proportion between said high pressure area and said low pressure area, and said control valve including a sleeve surrounding each said piston, and said sleeve being moveable with respect to said pump housing by an actuator between said first position and a second position, and said actuator being stoppable at a plurality of positions between said first position and said second position;

a spring operably positioned to bias said control valve toward a position at which said piston displaces a majority of said fluid into said low pressure area;

a plurality of hydraulically actuated fuel injectors connected to said high pressure area;

a source of low pressure fluid connected to said low pressure area of said pump; and an electronic control module in communication with and capable of controlling a position of said control valve.

12. The hydraulically actuated system of claim 11 further comprising a pressure sensor operably connected to said high pressure and capable of communicating a pressure signal to said electronic control module; and said position of said control valve is a function of said pressure signal.

13. The hydraulically actuated system of claim 12 further comprising an engine operating condition sensor capable of communicating an operating condition signal to said electronic control module; and said position of said control valve is also a function of said operating condition signal.

14. The hydraulically actuated system of claim 13 wherein said piston moves a fixed reciprocation distance with each pump cycle; and an actuator distance between said first position and said second position is about equal to said reciprocation distance.

15. The hydraulically actuated system of claim 14 wherein said internal passage extends between a pressure face end and a side surface; and said sleeve blocks said internal passage over a portion of said reciprocation distance.

16. The hydraulically actuated system of claim 15 wherein substantially all fluid displaced by said piston goes into said high pressure area when said control valve is at said first position; and substantially all fluid displaced by said piston goes into said low pressure area when said control valve is at said second position.

17. The hydraulically actuated system of claim 16 wherein said actuator includes a solenoid, and said position of said actuator is proportional to an amount of current supplied to said solenoid.

18. A hydraulically actuated system comprising:

a fixed displacement pump with at least one piston defining an internal passage and that reciprocates in a pump housing that defines a high pressure area and a low pressure area;

a control valve attached to said housing and being moveable between a first position in which said piston displaces fluid in a first proportion between said high pressure area and said low pressure area, and a second position in which said piston displaces fluid in a second proportion between said high pressure area and said low pressure area, and said control valve including a sleeve surrounding each said piston, and said sleeve being moveable with respect to said pump housing by an actuator between said first position and a second position, and said actuator being stoppable at a plurality of positions between said first position and said second position;

a plurality of hydraulically actuated fuel injectors fluidly connected to said high pressure area;

a source of low pressure fluid connected to said low pressure area of said pump;

an electronic control module in communication with and capable of controlling a position of said control valve to stop at said plurality of positions;

a pressure sensor operably connected to said high pressure area and capable of communicating a pressure signal to said electronic control module; and an engine operating condition sensor capable of communicating an operating condition signal to said electronic control module.

19. The hydraulically actuated system of claim 18 further comprising a spring operably positioned to bias said control valve toward a position at which said piston displaces a majority of said fluid into said low pressure area.

20. The hydraulically actuated system of claim 19 wherein substantially all fluid displaced by said pistons goes into said high pressure area when said control valve is at said first position; and substantially all fluid displaced by said pistons goes into said low pressure area when said control valve is at said second position.

* * * * *